US009925120B2

(12) United States Patent
Kropczynski et al.

(10) Patent No.: US 9,925,120 B2
(45) Date of Patent: Mar. 27, 2018

(54) CAP SUITABLE FOR USE WITH ENTERAL FEEDING CONTAINER

(71) Applicant: ABBOTT LABORATORIES, Abbott Park, IL (US)

(72) Inventors: John Kropczynski, Powell, OH (US); Jeremy McBroom, Columbus, OH (US); Meghan Linden, Dublin, OH (US)

(73) Assignee: ABBOTT LABORATORIES, Abbott Park, IL (US)

( * ) Notice: Subject to any disclaimer, the term of this patent is extended or adjusted under 35 U.S.C. 154(b) by 141 days.

(21) Appl. No.: 14/442,785

(22) PCT Filed: Nov. 13, 2013

(86) PCT No.: PCT/US2013/069878
§ 371 (c)(1),
(2) Date: May 14, 2015

(87) PCT Pub. No.: WO2014/078404
PCT Pub. Date: May 22, 2014

(65) Prior Publication Data

US 2015/0290081 A1 Oct. 15, 2015

Related U.S. Application Data

(60) Provisional application No. 61/726,272, filed on Nov. 14, 2012.

(51) Int. Cl.
*A61J 1/20* (2006.01)
*B65D 51/22* (2006.01)
(Continued)

(52) U.S. Cl.
CPC ..... *A61J 1/201* (2015.05); *A61J 1/1406* (2013.01); *A61J 1/1418* (2015.05); *A61J 1/2082* (2015.05);
(Continued)

(58) Field of Classification Search
CPC ..... A61J 1/1406; A61J 1/1418; A61J 1/1481; A61J 1/201; A61J 9/00; A61J 1/1475; A61M 2202/0482; A61M 2039/1072
(Continued)

(56) References Cited

U.S. PATENT DOCUMENTS 4,519,513 A * 5/1985 Weiler ..... A61J 1/1406 215/247
5,188,628 A * 2/1993 Rani ..... B65D 51/002 215/248
(Continued)

FOREIGN PATENT DOCUMENTS

CN 101193804 A 6/2008
CN 102458561 A 5/2012
(Continued)

OTHER PUBLICATIONS

English Translation of Chinese Patent Application No. 201380059355.1 dated Oct. 10, 2016.
(Continued)

*Primary Examiner* — Gerald Landry, II
(74) *Attorney, Agent, or Firm* — Calfee, Halter & Griswold, LLP

(57) ABSTRACT

A cap for use in enteral feeding from a container. The cap includes a base and an insert cutter. The base has a top surface, a bottom surface, and an outer ring. The top surface has a protruding port suitable for insertion of a spike connector. The protruding port defines a spike insertion chamber extending from a spike connector insert aperture to
(Continued)

a spike connector outlet aperture. The outer ring is configured for attachment to a container having a mouth. The insert cutter has a first end portion attached to the bottom surface of the base and about an edge of the spike connector outlet aperture and a second end portion extending over at least a portion of the spike connector outlet aperture. The insert cutter is capable of flexing in an insertion direction of a spike connector inserted through the spike insertion chamber.

22 Claims, 9 Drawing Sheets

(51) Int. Cl.
*A61J 1/14* (2006.01)
*A61J 9/00* (2006.01)

(52) U.S. Cl.
CPC ..... *B65D 51/226* (2013.01); *A61J 1/1462* (2013.01); *A61J 1/1481* (2015.05); *A61J 9/00* (2013.01); *B65D 2547/06* (2013.01)

(58) Field of Classification Search
USPC ..... 604/244, 256, 403, 411, 414, 533
See application file for complete search history.

(56) References Cited

U.S. PATENT DOCUMENTS 5,782,383 A * 7/1998 Robinson ..... A61J 1/1406 215/250
6,364,143 B1 * 4/2002 Knierbein ..... A61J 1/10 215/247
6,408,904 B1 * 6/2002 Dushman ..... B67D 3/0032 141/352
2004/0153047 A1 * 8/2004 Blank ..... A61M 5/162 604/408
2007/0032775 A1 * 2/2007 Niedospial, Jr. ..... A61J 1/2096 604/415
2010/0030164 A1 * 2/2010 Kimball ..... A61M 39/02 604/256
2010/0298805 A1 * 11/2010 Niedospial, Jr. ..... A61J 1/2096 604/411
2011/0259847 A1 * 10/2011 Cox ..... A61J 9/04 215/391
2012/0040058 A1 2/2012 Colo et al.
2012/0184938 A1 * 7/2012 Lev ..... A61J 1/1406 604/414
2012/0232524 A1 * 9/2012 Hyun ..... A61M 5/3129 604/514
2012/0289936 A1 * 11/2012 Ingram ..... A61J 15/00 604/514
2012/0310177 A1 * 12/2012 Becker ..... A61J 1/1406 604/244

FOREIGN PATENT DOCUMENTS

DE 20017609 U1 1/2001
DE 102006041414 A1 3/2008
EP 2417958 A1 10/2010
EP 1765254 B1 2/2012
EP 2059212 B1 2/2012
JP 2002520093 A 7/2002
WO 2010132427 A1 11/2010
WO 2011043336 A 4/2014

OTHER PUBLICATIONS

Communication Under Rule 71(3) EPC from European Application No. 13798836.6 dated Dec. 6, 2016.
International Search Report and Written Opinion from PCT/US2013/069878 dated Feb. 19, 2014.
International Preliminary Report on Patentability Search Report from PCT/US2013/069878 dated May 28, 2015.
Office Action from Canadian Patent Application No. 2,890,235 dated Mar. 23, 2016.
English Translation of Second Chinese Patent Application No. 201380059355.1 dated May 25, 2017.
English Translation of Japanese Patent Application No. 2015-542032 dated Sep. 19, 2017.

* cited by examiner

CAP SUITABLE FOR USE WITH ENTERAL FEEDING CONTAINER

CROSS REFERENCE TO RELATED APPLICATIONS

This application is the U.S. national stage entry of PCT/US2013/069878 with an international filing date of 13 Nov. 2013 claims priority to and any benefit of U.S. Provisional Application No. 61/726,272, entitled CAP SUITABLE FOR USE WITH ENTERAL FEEDING CONTAINER and filed Nov. 14, 2012, the entire contents of which are incorporated herein by reference in their entirety.

BACKGROUND

Enteral feeding developed from a need to maintain a sufficient caloric diet in a patient who might otherwise not digest enough calories by oral intake. The medical reasons for enteral feeding are numerous and relatively varied. Certain patients temporarily lose the ability to chew, such as for example, if the patient is comatose, in a prolonged unconscious state following surgery, or has suffered a jaw or throat injury. Other patients may lose the ability to swallow as a result of declining health from degenerative disorders of the muscle or nervous system, such as Parkinson's or Amyotrophic lateral sclerosis (ALS). In patients presenting with these or other conditions, a physician or care provider may elect to provide a diet by enteral feeding. The enteral feeding is often temporary until recovery, or until other feeding methods are initiated, such as for example, by percutaneous endoscopic gastrostomy (a PEG tube).

Conventional enteral feeding involves the delivery of a liquid nutrition (e.g., a nutritional formula) through the oral tract into the digestive system. Using gravity or a pumping device, the liquid nutrition is delivered to the stomach from a container. Specifically, the liquid nutrition travels through a tube which has been intubated into the oral tract, usually through the nose. A physician may choose liquid nutrition specific to the patient from many commercially available nutritional formulas.

One type of liquid nutrition container used in the industry is a ready-to-hang plastic bottle. The bottle may include a mouth covered by a hermetic seal and a neck which is male threaded. In many enteral feeding systems, a removable cap is attached to the neck of the bottle. To initiate flow of the nutrition, the seal is removed by a caregiver, mechanically broken or otherwise compromised. The tube connecting the container to the patient has a proximal end, relative the caregiver, which may include a connector or otherwise have structure adapted for connection to the cap.

SUMMARY

The present application describes parts and assemblies for use in enteral feeding, such as for example, a cap suitable for use with a ready-to-hang plastic bottle.

In an exemplary embodiment, a cap includes a base and an insert cutter. The base has a top surface, a bottom surface, and an outer ring, the top surface having a protruding port suitable for insertion of a spike connector and the outer ring configured for attachment to a container having a mouth. The protruding port defines a spike insertion chamber extending from a spike connector insert aperture to a spike connector outlet aperture. The insert cutter has a first end portion attached to the bottom surface of the base and about an edge of the spike connector outlet aperture and a second end portion extending over at least a portion of the spike connector outlet aperture. The insert cutter is capable of flexing at a hinge in an insertion direction of a spike connector inserted through the spike insertion chamber.

In another embodiment, an assembly includes a container having a mouth covered by a foil seal, a cap, and an insert cutter. The cap has a top surface, a bottom surface, and an outer ring, the top surface having a protruding port suitable for insertion of a spike connector and the outer ring configured for attachment to the mouth of the container. The protruding port defines a spike insertion chamber extending from a spike connector insert aperture to a spike connector outlet aperture. The insert cutter has a first end portion attached to the bottom surface of the cap and about an edge of the spike connector outlet aperture and a second end portion extending over at least a portion of the spike connector outlet aperture. The insert cutter is capable of flexing at a hinge in an insertion direction of a spike connector inserted through the spike insertion chamber.

BRIEF DESCRIPTION OF THE DRAWINGS

Features and advantages of the general inventive concepts will become apparent from the following detailed description made with reference to the accompanying drawings.

DETAILED DESCRIPTION

Figure 1:
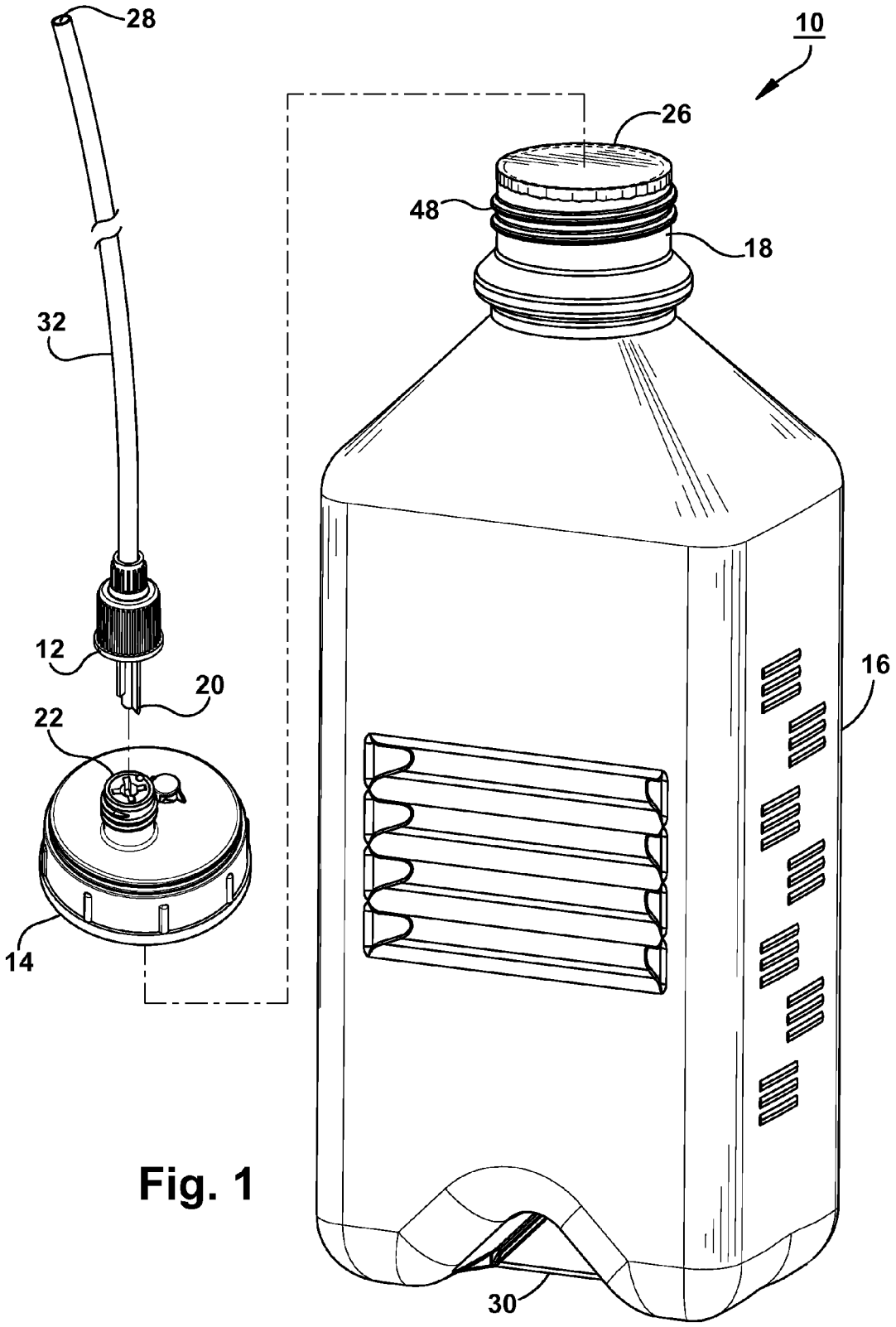
FIG. 1 is an exploded view of an enteral feeding assembly, showing a connector, a cap, and a container.

This Detailed Description merely describes exemplary embodiments in accordance with the general inventive concepts and is not intended to limit the scope of the invention in any way. Indeed, the invention as described by the claims is broader than and unlimited by the exemplary embodiments set forth herein, and the terms used herein have their full ordinary meaning.

The general inventive concepts will now be described with occasional reference to the exemplary embodiments of the invention. This general inventive concept may, however, be embodied in different forms and should not be construed as limited to the embodiments set forth herein. Rather, these embodiments are provided so that this disclosure will be thorough and complete, and will fully convey the scope of the general inventive concepts to those skilled in the art.

Unless otherwise defined, all technical and scientific terms used herein have the same meaning as commonly understood by one of ordinary skill in the art encompassing the general inventive concepts. The terminology set forth in this detailed description is for describing particular embodiments only and is not intended to be limiting of the general inventive concepts. As used in this detailed description and the appended claims, the singular forms "a," "an," and "the" are intended to include the plural forms as well, unless the context clearly indicates otherwise.

Unless otherwise indicated, all numbers expressing quantities of ingredients, properties such as molecular weight, reaction conditions, and so forth as used in the specification and claims are to be understood as being modified in all instances by the term "about." Accordingly, unless otherwise indicated, the numerical properties set forth in the specification and claims are approximations that may vary depending on the suitable properties sought to be obtained in embodiments of the present invention. Notwithstanding that the numerical ranges and parameters setting forth the broad scope of the general inventive concepts are approximations, the numerical values set forth in the specific examples are reported as precisely as possible. Any numerical values, however, inherently contain certain errors necessarily resulting from error found in their respective measurements.

In the application of certain enteral feeding containers in the art, misconnections with other tubing have occurred. A tube connector was developed to prohibit this undesired situation. The SPIKERIGHT® PLUS connector is designed for connection to a soft-sided container, such as a plastic bag, having a protruding port compatible with the connector.

The present application describes, in part, an adapter cap suitable for use with a ready-to-hang container used for enteral feeding. The cap is intended to be compatible with the SPIKERIGHT® PLUS connector and meets all known and current AAMI/ISO misconnection requirements. The underside of the cap includes a hinged insert cutter which is capable of flexing into the container seal upon insertion of the SPIKERIGHT® PLUS connector. The insert cutter compromises or pierces the seal to promote liquid flow from a container. The port also prohibits misconnection with other types of tubing. In certain embodiments, the cap includes a hole with a filter to help facilitate air flow into the container. In certain embodiments that contain a filter, a raised cover over the filter prohibits accidental connections of the tube connector with the filter.

The cap functions as part of a closed system which allows connection of the SPIKERIGHT® PLUS connector, or a similar connector, without manual removal of the hermetic seal. In application, the SPIKERIGHT® PLUS connector, or a similar connector, acts as both the "key and the tool" to actuate flow of the liquid nutrition. After insertion of the connector into the protruding port on the cap, the spike end of the connector contacts the hinged insert cutter on the underside of the cap. The insert cutter will then flex at the hinge into the container seal to promote nutrition flow. Once the cap has been installed over the mouth of the container, insertion of the spike is the only practical way of allowing flow between the container and an inserted connector. In one exemplary embodiment, the insertion force necessary to break the seal and promote flow is less than the force required for insertion through the raised cover over the filter.

Referring now to the drawings, one exemplary embodiment of an enteral feeding assembly 10 is shown in FIG. 1. The exploded view illustrates a connector 12, a cap 14, and a container 16, all in an orientation in which a caregiver may use during initial assembly. The connector 12 is illustrated to represent a SPIKERIGHT® PLUS connector. Any variations between the figures of this application and the actual shape, size, or structure of a SPIKERIGHT® PLUS connector are not intended. Further, any future modifications to the SPIKERIGHT® PLUS connector should not be interpreted to limit the scope of the present invention. However, it is specifically contemplated that the cap disclosed herein may be suitable for use with other connectors that may vary in one or more aspects from the SPIKERIGHT® PLUS connector.

Figure 6A:
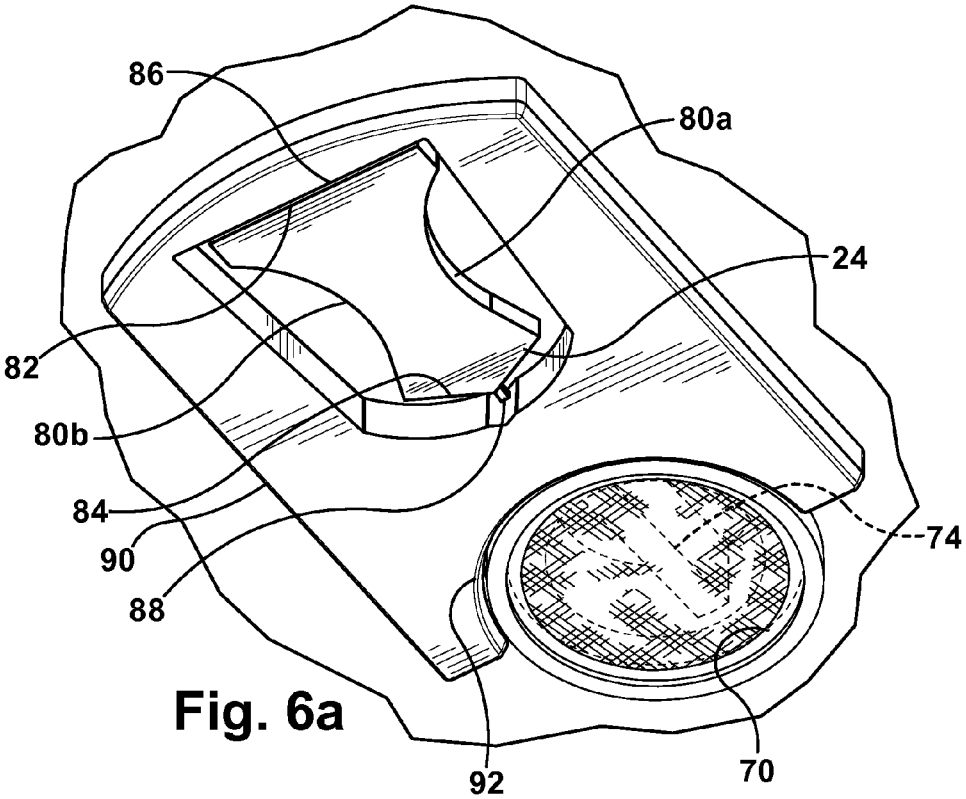
FIG. 6*a* is a bottom perspective view of a portion of the cap, showing an insert cutter and a filter.
Figure 6B:
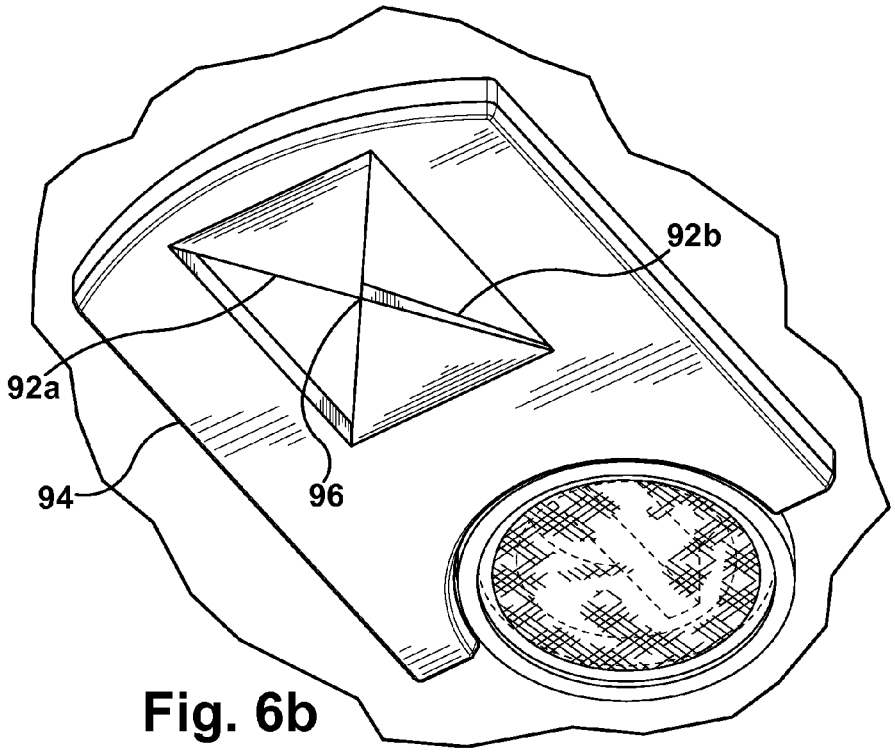
FIG. 6*b* is a bottom perspective view of a portion of another cap, showing two doors of an insert cutter and a filter.

In a typical use, the cap 14 is threaded onto a neck 18 of the container 16, followed by insertion of the spike 20 into a protruding port 22 of the cap 14. Insertion of the spike 20 flexes a hinged insert cutter 24 (see FIGS. 6-8) into the seal 26 over a mouth of the container 16. The seal may be aluminum foil, a multi-laminate, or other suitable material sufficiently to hermetically seal the liquid within the container. After the distal end 28 of a tube 32 is intubated into the oral tract, the container 16 is hung upside down, such as on a hook or other fastening device, by an optional catch 30 to initiate flow by gravity or pump delivery. In the exemplary embodiment, the container 16 is a plastic bottle, but it will be understood by those skilled in the art that other containers may be suitable for use with the various embodiments of the cap disclosed herein.

Figure 2A:
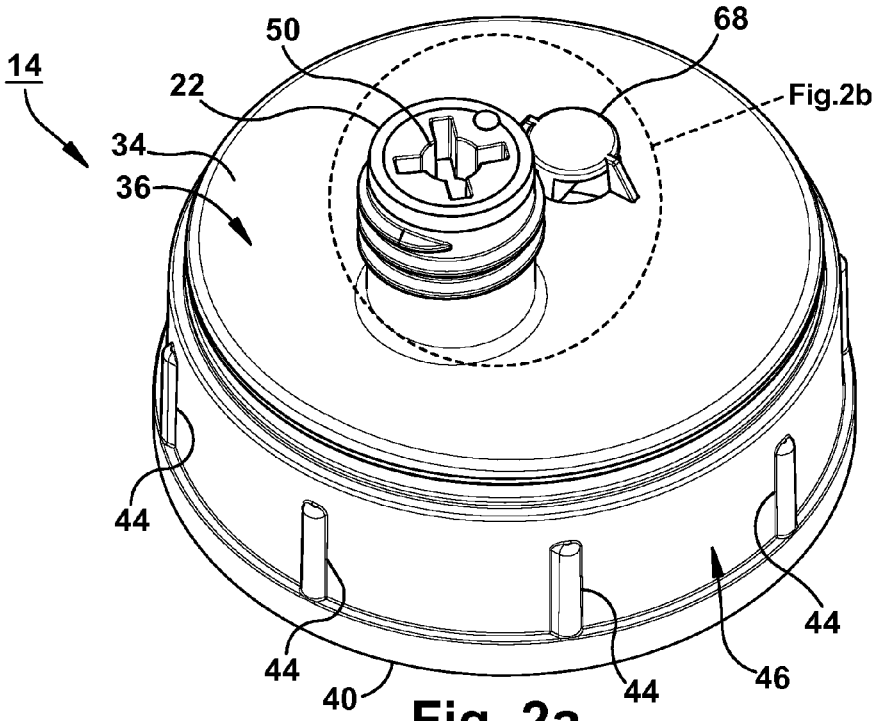
FIG. 2*a* is a top perspective view of the cap of FIG. 1.
Figure 2B:
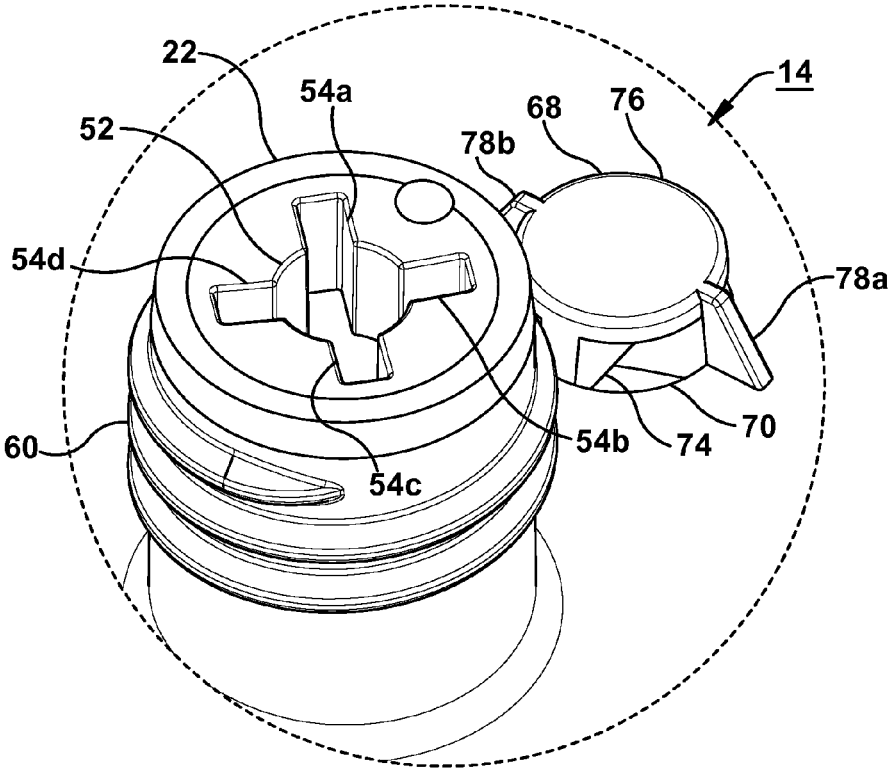
FIG. 2*b* is an enlarged perspective view of the designated circular area of FIG. 2*a;*

The exemplary cap 14 of FIG. 1 is illustrated in FIGS. 2*a* and 2*b*. In certain embodiments, the cap is an integral plastic piece formed such as by injection molding. The cap includes a base 34 having a top 36 and bottom surface 38 (best seen in FIG. 5*b*). An outer ring 40 has female threads on an inner surface 42 (see FIG. 5*a*) and optional ridges 44 on an outer surface 46. Generally, the inner surface 42 is cooperatively threaded for attachment to male threads 48 on the neck 18 of the container 16. In certain embodiments, the cap may be constructed of two or more parts. For example, the cap may include a separate base, or disk, and a separate outer ring, which are joined to each other prior to assembly, or otherwise engage each other at or prior to the time of attachment to the container. Also, it will be understood by those skilled in the art that the cap may be constructed by alternative suitable manufacturing methods and alternative suitable materials in the practice of the present invention.

The cap 14 is configured to prohibit compromise of the container seal 26 by any connector other than an enteral connector (e.g. a SPIKERIGHT® PLUS connector), such as for example, connectors with different shape bores, or different size bores, such as a small bore IV tube connector. A top perspective view of the cap 14 is shown in FIG. 2*a*. As shown, the top surface 36 of the cap 14 has a protruding port 22 suitable for insertion of a spike connector. The port 22 has a top surface which defines a spike connector insert aperture which is cooperatively shaped to accept a spike connector. As best seen in FIG. 2*b*, the exemplary spike insertion aperture 50 is generally cross-shaped and includes a circular center 52 and four wing extensions 54*a*, 54*b*, 54*c*, 54*d*. Discussed herein, the exemplary wings are evenly spaced around the circumference of the circular center 52, and permit the connector 12 to be inserted in four unique positions. Other configurations for the spike insertion aperture may be utilized and should be considered to be within the scope of the present invention.

Figure 5A:
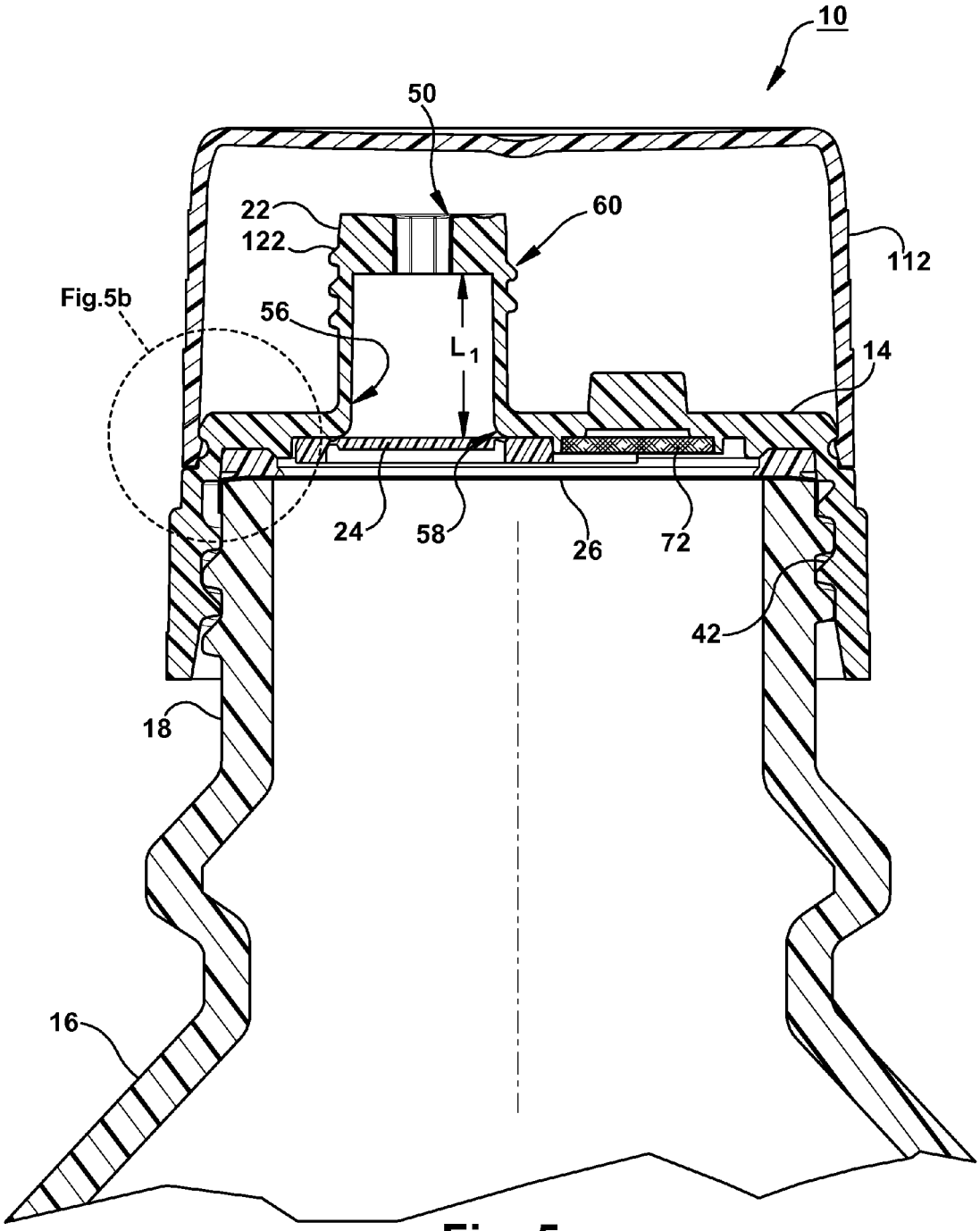
FIG. 5*a* is a sectional view of a top portion of the assembly of FIG. 1, shown with the cap secured to the container and with a dust cover over the cap.

In certain embodiments, the inside surface of the protruding port is generally shaped to cooperatively engage the spike connecter. Further structural detail of an exemplary protruding port is illustrated in FIG. 5*a*, in which a sectional view of the assembly 10 is shown. In FIG. 5*a*, the cap 14 is illustrated in an assembled position on the neck 18 of the container 16. A sectional view of the protruding port 22 shows a spike insertion chamber 56 extending from a spike connector insert aperture 50 to a spike connector outlet aperture 58. The exemplary chamber 56 shown has a length $L_1$ in which the chamber is cylindrical in shape. It will be understood by one skilled in the art that the shape of the chamber may vary, such as for example, the chamber may be cross shaped its entire length.

In certain embodiments, the outside surface of the protruding port is also shaped to cooperatively engage the spike connecter. Various configurations are possible for cooperative engagement. In exemplary protruding port 22 shown in FIGS. 2*a* and 2*b*, the outside surface has a threaded outer circumferential surface 60. The male threads of the port are capable of engaging female threads on a surface 62 of the spike connector 12 (see FIGS. 3 and 5*d*). As discussed herein, a threaded connection between the protruding port and the spike connector assists in inserting the connector 12 spike 20 from an initial engagement position to a lower assembled position.

In certain embodiments, the cap is structured to permit air flow from outside the assembly to inside the container to aid the gravitational flow of fluid. As best seen in FIGS. 2*a* and 2*b* in the illustrated embodiment, the cap 14 includes an optional raised dome 68 which generally covers an optional hole 70 in the base 34 of the cap 14. Although the hole is pictured in the base of the cap, other structures for permitting air flow from outside the container to inside the container may be utilized. As shown in the sectional views of the assembly 10 in FIGS. 5*a*-5*d*, the cap 22 further includes an optional filter 72. The filter 72 permits air flow through the hole 70 in the base 34. As positioned, the raised dome 68 prohibits insertion of an unintended or undesired object through the hole 70 in the insertion direction $D_1$ of the spike connector 12.

Referring again to FIG. 2*b*, a possible structure for the exemplary raised dome is shown. In the illustrated embodiment, two buttress supports 78*a*, 78*b* are separated by a uniform wall 74 which extends from a side of the hole 70 to an opposing side. The supports 78*a*, 78*b* and wall 74 collectively support a dome ceiling 76. The underside of the wall 70 is shown in phantom in FIGS. 6*a* and 6*b* in a position above the filter 72. The exemplary ceiling 76 is a solid disk without holes. The solid disk prohibits a spike connector from being inserted through the hole 70. Relative to the embodiment illustrated, insertion forces were measured of prepared prototypes. The exemplary solid disk prevented a spike being inserted with at least 70 N of force. It should be understood that the insertion resistant strength of the raised dome may vary in the practice of the invention, such as for example, the force required to insert a spike through the hole may be more than or less than 70 N.

The exemplary configuration of the raised dome 68 in FIG. 2*b* allows air flow between the filter 72 and the dome, and into the container. Specifically, air flows from outside the assembly through entrance passages, each passage formed by one of the buttress supports 78*a*, 78*b* and the wall 74, and then through the filter 72 and into the container. It should be understood that the shape, size, and structure of the raised dome may vary in the practice of the invention, such as for example, the air passages, the buttress support, or the ceiling may be of a different size or shape. Further, it is specifically contemplated that the cap may be used in a configuration that does not have a hole and filter, in a configuration that has a hole and filter, but does not have a dome cover, or in a configuration that has more than one hole.

Figure 7:
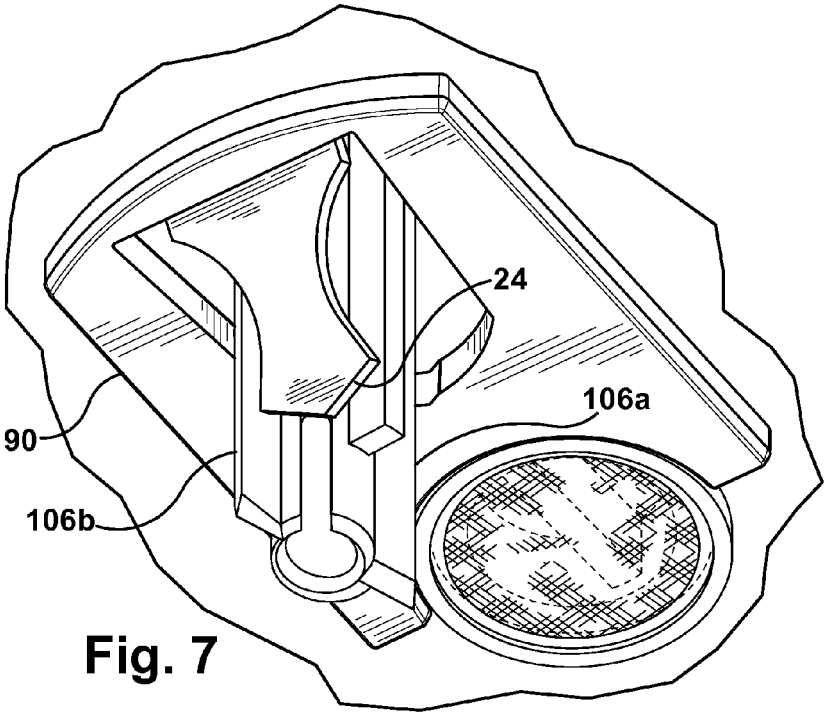
FIG. 7 is a bottom perspective view of a portion of the cap of FIG. 1, shown with the connector in an installed position.
Figure 8:
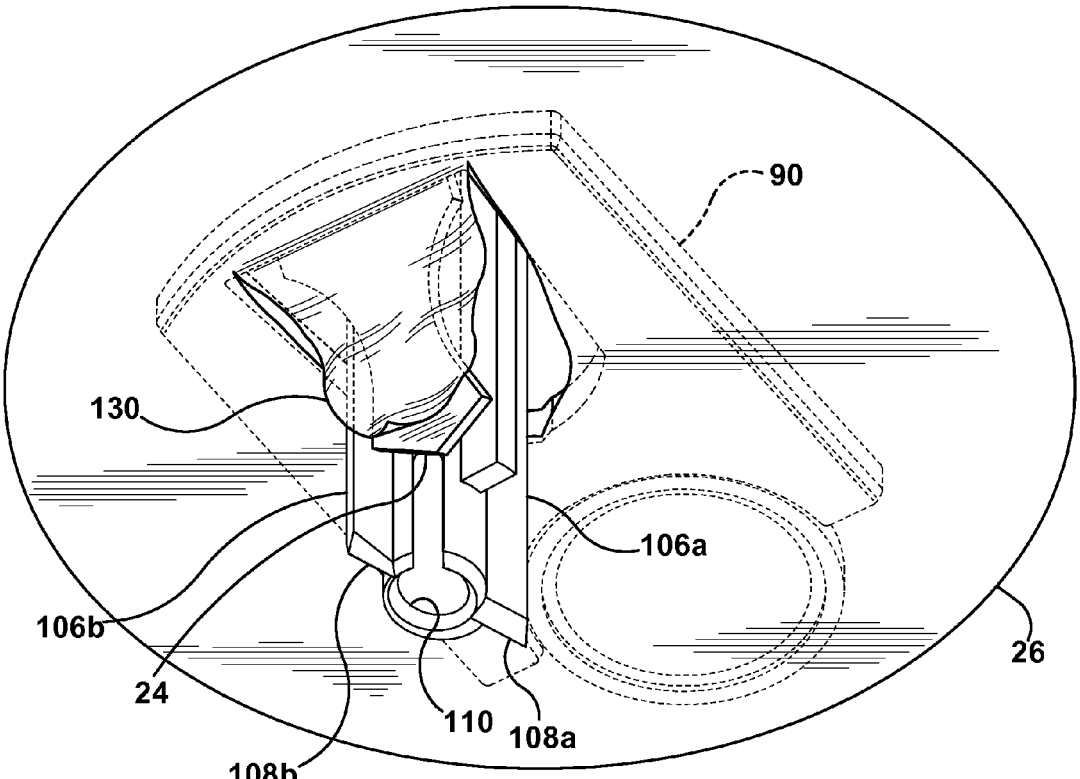
FIG. 8 is a bottom perspective view of a portion of the assembly of FIG. 1 shown with the connector in an installed position and with the insert cutter pierced through a seal over a mouth of the container.

Another inventive feature of the cap is an insert cutter for promoting nutrition flow from the container into the tube 32. FIG. 6*a* illustrates one exemplary embodiment of an insert cutter 24. Specifically, FIGS. 6*a* and 7 are bottom perspective views of portion of the cap, shown in a disassembled position such that the container seal 26 is not visible. In contrast, FIG. 8 is a bottom perspective view of a portion of the cap in an assembled position on the container. The insert cutter 24 has a first end portion 82 attached to the bottom surface 38 of the base 34 and about an edge of the spike connector outlet aperture 58 (see FIGS. 5*a*-5*d*). A second end portion 84 extends over at least a portion of the spike connector outlet aperture, as viewed from within the container. The insert cutter 24 is capable of flexing at a hinge 86 in an insertion direction $D_1$ of a spike connector 20 inserted through the spike insertion chamber 56. Discussed herein, flexing of the insert cutter 24 is shown in FIGS. 5*d* and 8. As shown, the insert cutter 24 remains rigid after contact by the spike 20 and rotation at the hinge. In the exemplary embodiment, the insert cutter remaining rigid should not be interpreted as the insert cutter does not flex about the hinge. Rather, rigid is used to mean the insert cutter, after being contacted by the end of a spike, does not deform or otherwise bend out of the way of the advancing spike, and flexes in a direction of the advancing spike to pierce the seal of the container.

Referring again to FIG. 6*a*, in the embodiment illustrated the inset cutter 24 is generally hourglass-shaped and is defined by two concave sides 80*a*, 80*b*. The second end portion 84 is triangle-shaped and ends in a point. At the farthermost extending point, a bridge 88 joins the insert cutter 24 to an insert cutter housing 90. An inserted spike 20 through the spike insertion chamber 56 will break the bridge. In other words, the spike 20 will contact the insert cutter 24 prior to contact with the seal 26 (see FIG. 5*a*). In another embodiment, the inserted spike contacts the seal 26 prior to contacting the insert cutter 24.

In certain embodiments, exemplary housing 90 and insert cutter 24 is an integral substantially rigid piece of injection molded plastic. The housing 90 and insert cutter 24 are secured to the base such that only the insert cutter moves upon contact by the spike 20. For example, the insert cutter may be attached to the bottom surface 38 of the base 34 by ultrasonic welding, or for example, by a sealant, epoxy or adhesive.

It should be understood that the housing and insert cutter may be constructed in separate pieces, and may be constructed by alternative suitable methods and alternative suitable materials. Also, the insert cutter may be of a different shape, or more than one insert cutter may be used. For example, an insert cutter with two generally triangle-shaped doors 92*a*, 92*b* are shown hinged to a housing 94 in FIG. 6*b*. The farthest extending point of each door meets at a joint 96. The pointed ends of each door 92*a*, 92*b* separate and rotate apart when contacted by a spike 20. As such, the door 92*a*, 92*b* open in a saloon-door style upon insertion of the spike.

Figure 3:
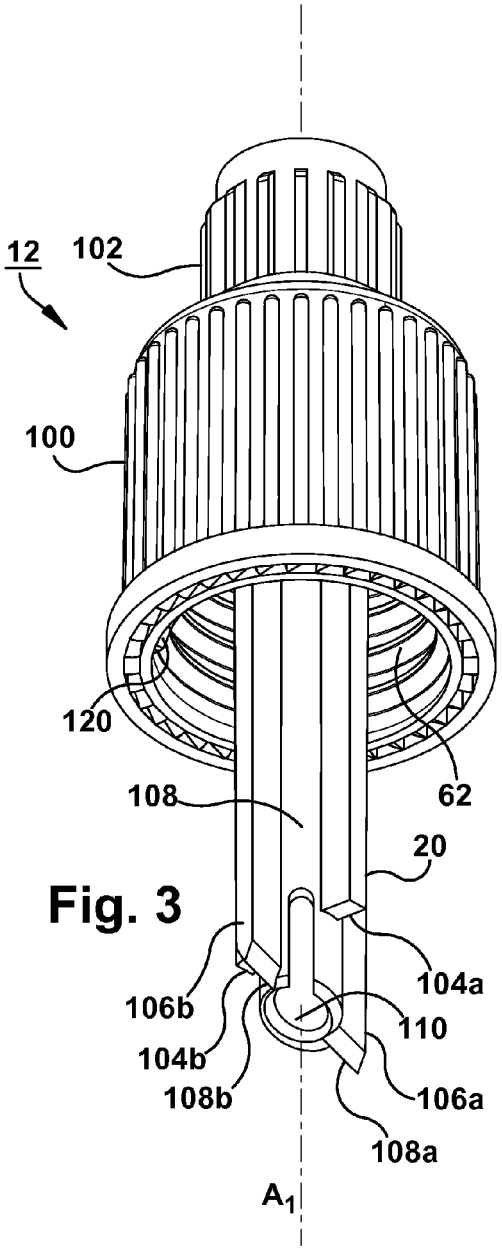
FIG. 3 is a bottom perspective view of the connector of FIG. 1.
Figure 4:
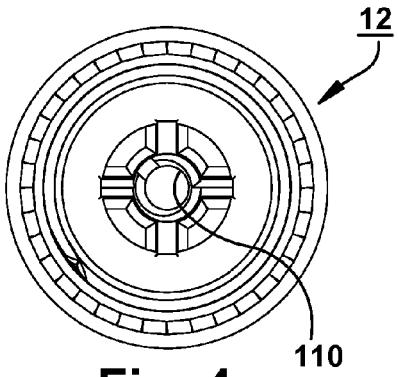
FIG. 4 is a bottom view of the connector of FIG. 1.

Referring to FIGS. 3 and 4, an exemplary connector 12 is illustrated in a bottom perspective view and a bottom view, respectively. The connector 12 includes a spike 20, a lower dial 100, and an upper dial 102, all axially arranged about a common longitudinal axis $A_1$. The outer surface of each dial 100, 102 are optionally ridged to allow for user gripping. In the embodiment illustrated, upper dial 102 is fixed relative to the spike 20, such that the user may facilitate insertion of the spike 20 into the protruding port 22 by grasping the upper dial. In the exemplary connector 12 illustrated in FIG. 5*d*, the upper dial 102 and the spike are an integral piece. However, other embodiments the upper dial and spike may be constructed of two or more parts. The lower dial 100 rotates clockwise and counterclockwise relative to the spike 20 and upper dial 102.

As discussed, in certain embodiments the spike 20 is generally cross-shaped. Specifically, the spike may be formed by a hollow cylinder 108. The cylinder extends to an opening 110. After the connector 12 fully engages the cap 14 and the container is inverted, liquid nutrition within the container enters the opening 110 under the force of gravity. Two shorter ribs 104*a*, 104*b* are each positioned along the length of the spike 20 on opposing sides. Between the rib 104*a*, 104*b*, two longer and thinner ribs 106*a*, 106*b* extend along the length of the cylinder to a leading or beveled edge 108*a*, 108*b*, respectively.

The insertion end of the spike 20 is generally angled relative the top of the upper dial. In other words, the rib 106*a* is longer than the rib 106*b*, such that upon insertion of the spike 20 into the protruding port 22, the rib 106*a* contacts the insert cutter 24 prior to contact being made by the opposing rib 106*b*. For example, FIG. 5*d* shows an assembly 10 in which the first portion of the spike 20 to make contact with the insert cutter was the rib 106*a*.

Partial or complete examples of the assembly 10 are shown in FIGS. 5*a*-5*d*. Referring again to FIG. 5*a*, in the illustrated embodiment a cap 14 is removably secured to the container 18 by a threaded connection. An optional dust cover 112, is attached over the cap 14 to protect the assembly when the container has not been initially used, or when it has been partially used and is in temporary storage.

Figure 5B:
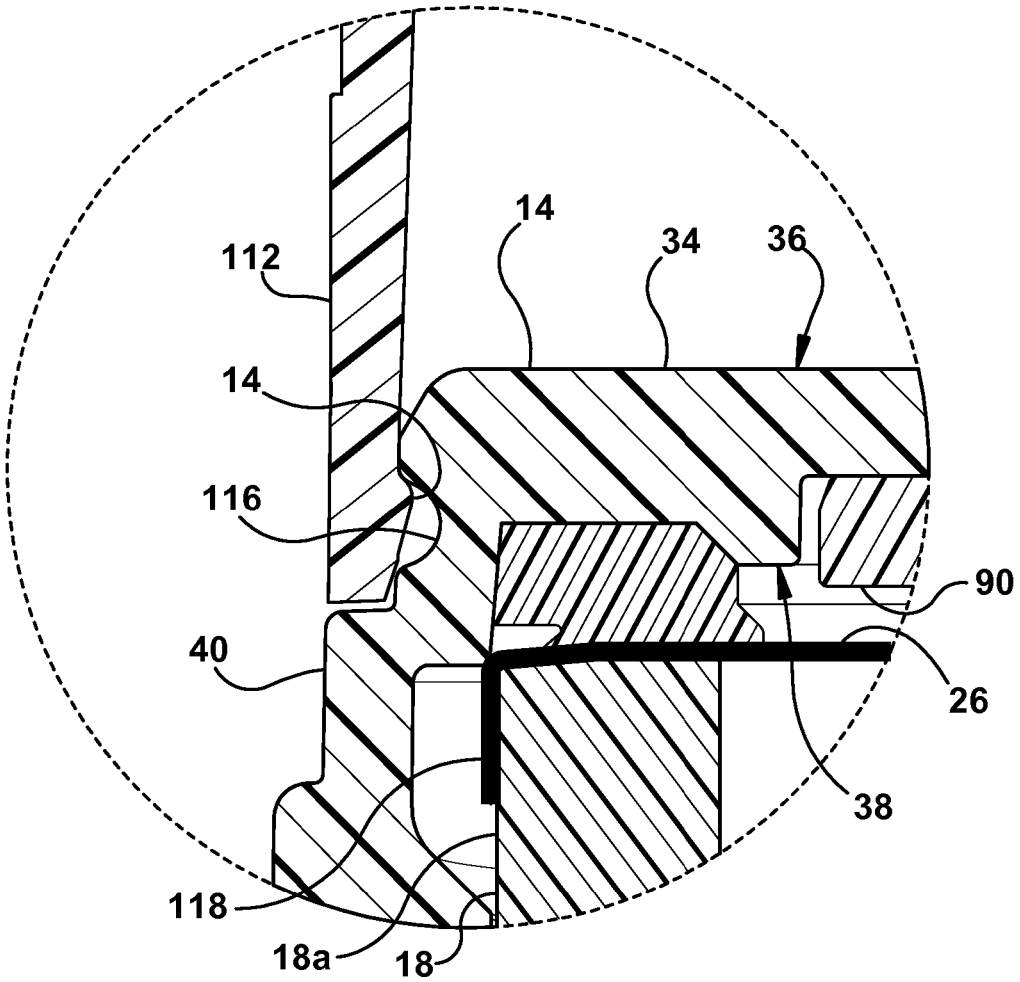
FIG. 5*b* is an enlarged perspective view of the designated circular area of FIG. 5*a;*

Referring now to FIG. 5*b*, an enlarged perspective view of the designated circular area of FIG. 5*a* is illustrated. The exemplary dust cover 112 is removably fixed to the base 34. In the embodiment illustrated, the dust cover is manually press-fit on the base such that an inwardly protruding rim 114 advances downward and into a concave recess 116 in the circumference of the base 34. As shown, the dust cover 112 has an outer diameter equal to an outer diameter of the ring 40 at an essentially contiguous location, such that a user may conveniently grasp the assembled dust cover 112 and cap 34.

Still referring to FIG. 5*b*, detail of the seal 26 is also shown. The seal 26 hermetically protects liquid within the container 16 until ready for use. In certain embodiments, the edge portion of the seal may be crimped or otherwise fixed to the top portion of the neck. The seal may extend downward a constant length around the circumference of the neck. As shown in FIG. 5*b*, a neck portion 18*a* is uncovered between the seal portion 118 and the ring 40.

Figure 5C:
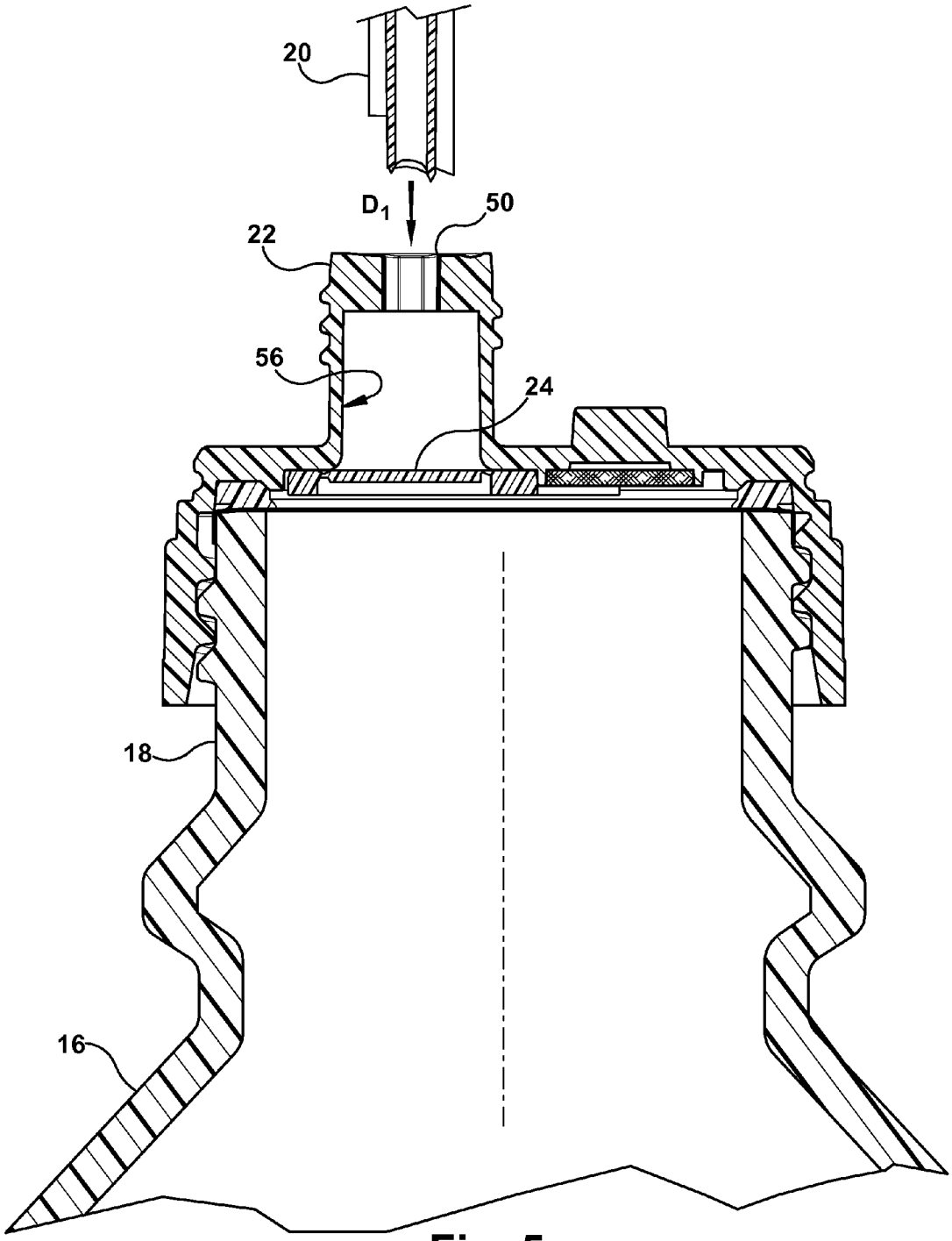
FIG. 5*c* is a sectional view of a top portion of the assembly of FIG. 1, shown with the cap secured to the container and with the connector in an installable orientation.
Figure 5D:
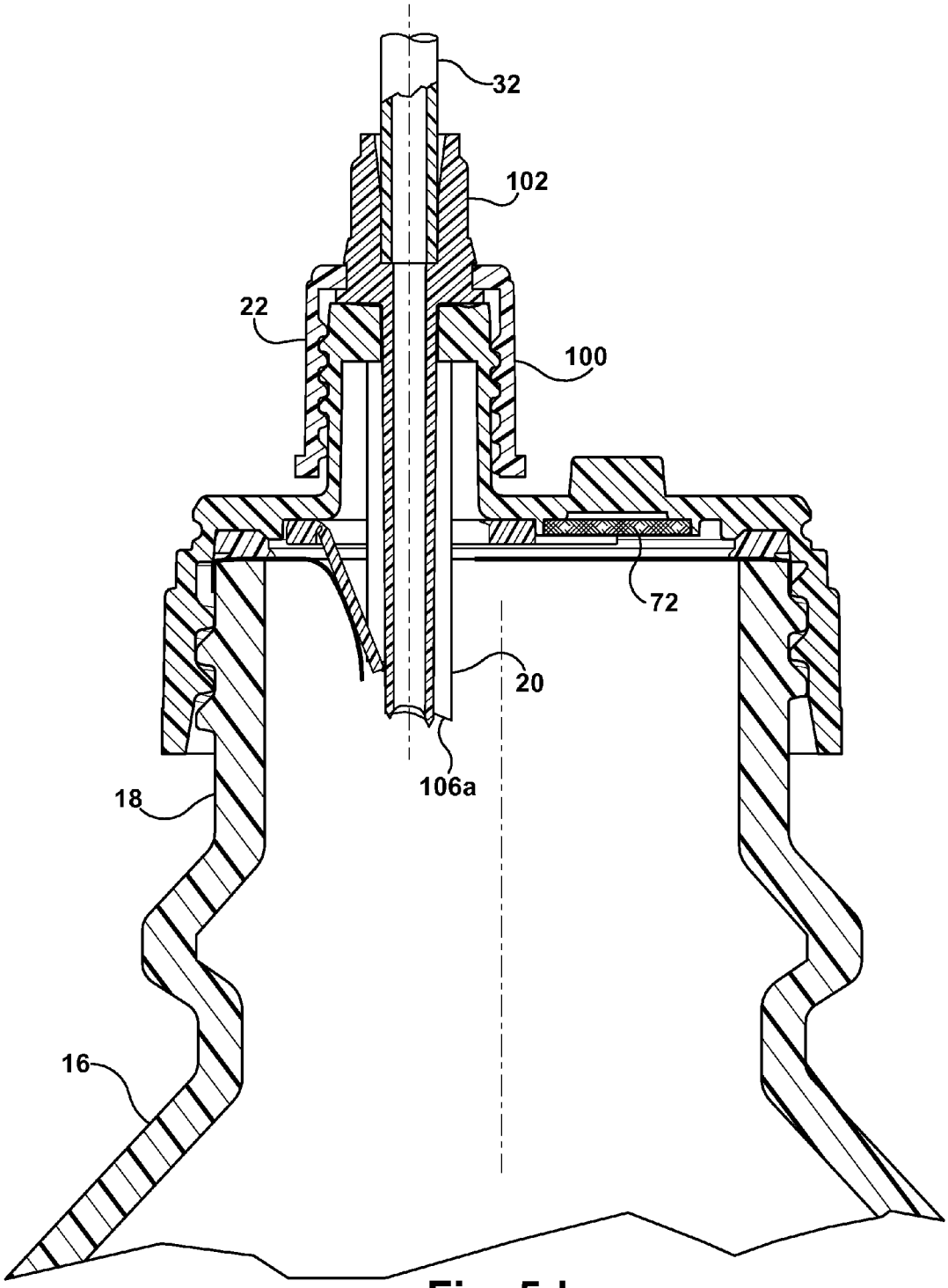
FIG. 5*d* is a sectional view of a top portion of the assembly of FIG. 1, shown with the cap secured to the container and with the connector in an installed position.

As discussed, the spike or spike connector is inserted into the protruding port to initiate liquid nutrition flow from the container. A sectional view of the cap 14 secured to the container 16 is shown in FIG. 5*c*. The spike 20 is illustrated in an installable orientation to relative the protruding port 22. A caregiver may insert the spike in a downward direction $D_1$ into the spike insertion aperture 50. As discussed, in certain embodiments the spike includes a leading rib 106*a* which a caregiver may insert into one of four wing extensions 54*a*, 54*b*, 54*c*, 54*d* in the spike insertion aperture 50 (see FIG. 2*b*). In an exemplary embodiment, the leading rib 106*a* is inserted into one of the two wing extensions 54*a*, 54*b* closest to the center of the cap. For example, the leading rib 106*a* is inserted into wing extension 54*b* in FIG. 7.

In certain contemplated uses, securing the spike to the cap is a two step process for the caregiver. The caregiver initially inserts the spike 20 into the spike insertion aperture 50 of the protruding port 22. In certain embodiments, the protruding port will have an outer circumferential surface configured to limit an insertion depth of the spike connector to an initial engagement position. Specifically, in certain embodiments the ending thread edge 120 of the female thread within the lower dial 100 will contact a shoulder 122 (see FIG. 5*a*) on the male threads on the protruding port 22, stopping movement of the spike 20 in the downward direction $D_1$. The caregiver may then rotate the lower dial 100 onto the threads of the protruding port to move the spike 22 to a lower assembled, or installed position, as seen in FIGS. 5*b* and 7. In other contemplated uses, various other embodiments and steps may be utilized.

As discussed, the insert cutter is configured to promote liquid flow from the container by sufficiently displacing the seal when a spike connector is in an installed position. Referring now to the embodiment illustrated in FIG. 8, a bottom perspective view of a portion of the assembly 10 is shown, with the connector in an installed position and with the insert cutter pierced through a seal over a mouth of the container. The insert cutter 24 is configured to pierce the seal 26 over the mouth of the container 16. Upon insertion of a spike 20 and sufficient displacement of the insert cutter 24, the end portion of the insert cutter pierces a seal 26 of the container 16. As the spike connector is engaged with the threaded outer circumferential surface of the protruding port 22, a seal tab 130 is broken away from the seal itself, and driven away from the opening 110 of the hollow cylinder 108. By piercing the seal and driving the compromised tab 130 into an innocuous position, flow of fluid from the container is promoted. In another embodiment of the insert cutter, the leading edge of the spike 20 may pierce the seal at the same time or prior to the insert cutter contacting the seal. It will be understood by one skilled in the art that various structural features, such as for example, the shape and size of insert cutter, and the particular wing extension into which the leading rib is inserted, will contribute to what portion of the assembly 10 first pierces the seal.

While various inventive aspects, concepts and features of the general inventive concepts are described and illustrated herein in the context of various exemplary embodiments, these various aspects, concepts and features may be used in many alternative embodiments, either individually or in various combinations and sub-combinations thereof. Unless expressly excluded herein all such combinations and sub-combinations are intended to be within the scope of the general inventive concepts. Still further, while various alternative embodiments as to the various aspects, concepts and features of the inventions (such as alternative materials, structures, configurations, methods, circuits, devices and components, alternatives as to form, fit and function, and so on) may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the general inventive concepts even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

What is claimed is:

1. A cap suitable for use in enteral feeding from a separate container, the cap comprising:

a base having a top surface, a bottom surface, and an outer ring, the top surface having a protruding port suitable for insertion of a spike connector and the outer ring configured to attach around a mouth of the separate container, wherein the protruding port defines a spike insertion chamber extending from a spike connector insert aperture to a spike connector outlet aperture; and an insert cutter having a first end portion attached to the bottom surface of the base and about an edge of the spike connector outlet aperture, a second end portion extending over at least a portion of the spike connector outlet aperture, and a hinge;

wherein the insert cutter is capable of flexing at the hinge in an insertion direction of a spike connector inserted through the spike insertion chamber.

2. The cap of claim 1 wherein the spike connector insert aperture is cross-shaped.

3. The cap of claim 1 wherein the insert cutter is configured to extend over at least a portion of the spike connector outlet aperture such that an inserted spike connector will engage a seal over a mouth of a container.

4. The cap of claim 1 wherein the insert cutter is rigid and flexes in the insertion direction of a spike connector when the spike connector is in an installed position within the spike insertion chamber.

5. The cap of claim 1 wherein the insert cutter is configured to promote liquid flow from a container by sufficiently displacing a seal over a mouth of a container when a spike connector is in an installed position.

6. The cap of claim 1 wherein the insert cutter is hourglass-shaped and the second end portion substantially ends in a point.

7. The cap of claim 1 wherein at least a portion of the insert cutter is triangle-shaped and the second end portion ends in a point.

8. The cap of claim 1 comprising a second insert cutter, wherein each of the two insert cutters is capable of flexing at a hinge in the insertion direction of a spike connector inserted through the spike insertion chamber.

9. The cap of claim 8 wherein the two insert cutters are capable of opening in a saloon door style.

10. The cap of claim 1 wherein the protruding port has an outer circumferential surface configured to limit an insertion depth of a spike connector.

11. The cap of claim 1 wherein the protruding port has a threaded outer circumferential surface, wherein upon insertion of a spike connector, the leading edge of the spike connector pierces a seal of a container upon the spike connector engaging the threaded outer circumferential surface of the protruding port.

12. The cap of claim 1 further comprising at least one filter permitting air flow through at least one hole in the base.

13. The cap of claim 12 further comprising:

a raised dome covering the hole in the base, wherein the dome is configured to prohibit insertion of an object through the hole in the insertion direction of a spike connector;

wherein the raised dome is configured to allow air flow between the at least one filter and the dome.

14. The cap of claim 1 further comprising a dust cover removably fixed to the base of the cap, wherein the dust cover has an outer diameter equal to an outer diameter of the base at a contiguous location.

15. A cap for use in enteral feeding from a container of liquid, the container having a mouth covered by a seal, the cap comprising:

a ring having a female threaded inner surface for attachment to the container;

a disk fixed to an upper edge of the ring, the disk having a top surface and a bottom surface, the top surface having a protruding port suitable for insertion of a spike connector, wherein the protruding port defines a spike insertion aperture; and an insert cutter having a first end, a second end, and a hinge, the first end attached to the bottom surface of the disk;

wherein the insert cutter is capable of flexing about the hinge in an insertion direction of a spike connector inserted through the spike insertion aperture.

16. The cap of claim 15 wherein the spike insertion aperture is cross-shaped.

17. The cap of claim 15 wherein the insert cutter is configured to promote liquid flow from a container by sufficiently displacing a seal over a mouth of a container when a spike connector is in an installed position.

18. An assembly for use in enteral feeding, the assembly comprising:

a container having a mouth covered by a foil seal;

a cap having a top surface, a bottom surface, and an outer ring, the top surface having a protruding port suitable for insertion of a spike connector and the outer ring configured for attachment to the mouth of the container, wherein the protruding port defines a spike insertion chamber extending from a spike connector insert aperture to a spike connector outlet aperture; and an insert cutter having a first end portion attached to the bottom surface of the cap and about an edge of the spike connector outlet aperture and a second end portion extending over at least a portion of the spike connector outlet aperture;

wherein the insert cutter is capable of flexing in an insertion direction of a spike connector inserted through the spike insertion chamber such that, after sufficient displacement, the insert cutter pierces the seal.

19. The assembly of claim 18 further comprising a catch on a container body suitable for engaging a hook.

20. The assembly of claim 18 wherein the container is filled with fluid, wherein the insert cutter is configured to promote liquid flow from the container by sufficiently displacing the seal when a spike connector is in an installed position.

21. The cap of claim 1 wherein the insert cutter does not seal the spike connector outlet aperture prior to the insertion of the spike connector through the spike insertion chamber.

22. The cap of claim 1 wherein the connector outlet aperture defines an open space adjacent to the insert cutter.

* * * * *